US008800807B2

(12) United States Patent
Alvares et al.

(10) Patent No.: US 8,800,807 B2
(45) Date of Patent: Aug. 12, 2014

(54) METAL SHEET CONTAINER FOR TRANSPORTING DANGEROUS PRODUCTS

(75) Inventors: Antonio Carlos Teixeira Alvares, Sao Paulo (BR); Silverio Candido da Cunha, Lajeado (BR)

(73) Assignee: Brasilata S.A. Embalagens Metalicas, San Paulo (BR)

( * ) Notice: Subject to any disclaimer, the term of this patent is extended or adjusted under 35 U.S.C. 154(b) by 178 days.

(21) Appl. No.: 13/320,423

(22) PCT Filed: May 12, 2010

(86) PCT No.: PCT/BR2010/000158

§ 371 (c)(1),
(2), (4) Date: Jan. 9, 2012

(87) PCT Pub. No.: WO2010/130020

PCT Pub. Date: Nov. 18, 2010

(65) Prior Publication Data

US 2012/0255960 A1 Oct. 11, 2012

(30) Foreign Application Priority Data

May 14, 2009 (BR) ..... 0901615

(51) Int. Cl.
*B65D 1/44* (2006.01)
*B65D 8/12* (2006.01)
*B65D 6/38* (2006.01)

(52) U.S. Cl.
USPC ..... 220/672

(58) Field of Classification Search
USPC ..... 220/628, 669–675
See application file for complete search history.

(56) References Cited

U.S. PATENT DOCUMENTS

| | | | | | |
|---|---|---|---|---|---|
| 900,166 | A | * | 10/1908 | Harry | 220/62.15 |
| 1,045,055 | A | * | 11/1912 | Mittinger, Jr. | 220/309.2 |
| 1,649,292 | A | * | 11/1927 | Draper | 220/672 |
| 2,780,378 | A | * | 2/1957 | Romano | 215/11.1 |
| 2,836,323 | A | * | 5/1958 | Robinson | 220/4.27 |
| 3,117,873 | A | * | 1/1964 | Bartels et al. | 426/131 |
| 3,949,877 | A | * | 4/1976 | Santoni | 206/519 |
| 4,316,551 | A | * | 2/1982 | Belokin, Jr. | 220/667 |
| 4,642,968 | A | * | 2/1987 | McHenry et al. | 53/425 |
| 4,667,454 | A | * | 5/1987 | McHenry et al. | 53/425 |
| 4,880,129 | A | * | 11/1989 | McHenry et al. | 220/609 |
| 5,799,808 | A | * | 9/1998 | Oh | 215/11.1 |

(Continued)

FOREIGN PATENT DOCUMENTS

| | | | |
|---|---|---|---|
| BR | 200200892 | A * | 2/2003 |
| DE | 954 679 | | 12/1956 |

(Continued)

*Primary Examiner* — Anthony Stashick
*Assistant Examiner* — Ned A Walker
(74) *Attorney, Agent, or Firm* — Harrington & Smith

(57) ABSTRACT

The container includes a body including a tubular side wall with upper and lower edges that are double-seamed to end walls. The tubular side wall includes a deformation region formed by circumferential friezes, which are parallel and adjacent to each other and have a Z-shaped profile with their end legs disposed in planes which define, with the axis of the tubular side wall, an angle between 45° and 90°. The end legs are interconnected by a median leg inclined in relation to the axis and defining, with the respective end legs, an angle not superior to 90°. The adjacent end legs of two consecutive friezes being coplanar and interconnected, by their opposite ends, to the respective median legs.

5 Claims, 3 Drawing Sheets

(56) References Cited

U.S. PATENT DOCUMENTS

| | | | | |
|---|---|---|---|---|
| 5,911,338 | A * | 6/1999 | Miller | 220/666 |
| 6,065,624 | A * | 5/2000 | Steinke | 215/383 |
| 6,712,575 | B1 * | 3/2004 | Tuma et al. | 413/2 |
| D494,067 | S * | 8/2004 | Teixeira Alvares et al. | D9/782 |
| 8,573,439 | B2 * | 11/2013 | Alvares et al. | 220/795 |
| 8,631,962 | B2 * | 1/2014 | Alvares et al. | 220/623 |
| 2004/0211747 | A1 * | 10/2004 | Whitley | 215/382 |
| 2006/0289379 | A1 * | 12/2006 | Ozawa et al. | 215/382 |
| 2009/0230012 | A1 * | 9/2009 | Choy et al. | 206/524.8 |
| 2011/0168730 | A1 * | 7/2011 | Alvares et al. | 220/795 |
| 2011/0210129 | A1 * | 9/2011 | Alvares et al. | 220/623 |
| 2011/0299959 | A1 * | 12/2011 | Alvares et al. | 413/6 |

FOREIGN PATENT DOCUMENTS

| | | | | |
|---|---|---|---|---|
| DE | 2417517 | A | * | 10/1975 |
| DE | 2417517 | A1 | | 10/1975 |
| FR | 349297 | A | * | 5/1905 |
| FR | 2705256 | A1 | * | 11/1994 |
| UY | 32173 | A | * | 12/2009 |
| WO | WO-95/29854 | A1 | | 11/1995 |
| WO | WO-02/47995 | A1 | | 6/2002 |
| WO | WO 03/076282 | A1 | | 9/2003 |
| WO | WO-03/076282 | A1 | | 9/2003 |
| WO | WO 2010017611 | A1 | * | 2/2010 |
| WO | WO 2010/040196 | A1 | | 4/2010 |

* cited by examiner

METAL SHEET CONTAINER FOR TRANSPORTING DANGEROUS PRODUCTS

FIELD OF THE INVENTION

The present invention refers to an improvement applied to a container in metal sheet, such as a can, pail or other metallic container of the type which comprises a side wall which is cylindrical or has a polygonal contour, generally square or rectangular, to whose end edges are double seamed a bottom wall and an upper wall, which can be annular, with a large discharge opening closed by a press-fit lid or by a single-piece lid provided with a small discharge opening. The invention allows the present can to be used for containing dangerous products in volumes of about 1 to 20 liters.

BACKGROUND OF THE INVENTION

It is known in the prior art the construction of containers in metal sheet, such as cans and pails, in which the side wall presents a square, rectangular or cylindrical contour, and the upper wall is provided in a single piece or in the form of a substantially circular large opening defined internally to a closure seat formed on the upper wall, throughout the opening periphery and incorporating a pending peripheral wall in whose interior the press-fit lid is seated.

In certain constructions, the pending peripheral wall, whose upper edge defines the closure seat, operates only as a sealing and retention element, by simple friction, in relation to a side wall of the press-fit lid to be fitted in the interior of said pending peripheral wall of the annular upper wall of the container.

In an also known construction object of the Brazilian Patent PI 9408643-5 of the same applicant, the lower portion of the pending peripheral wall is bent to the interior of the opening of the container, upwardly, until its free end edge reaches a position adjacent to said pending peripheral wall. In this previous construction of the same applicant, the pending peripheral wall, which surrounds and defines the discharge opening, incorporates a continuous tubular rib of circular cross-section, disposed in a plane lowered in relation to the plane of the closure seat, that is, of the upper edge of the pending peripheral wall.

Also according to the already filed prior solution, it is provided a lid presenting a peripheral edge, generally defined by an outwardly and downwardly bent continuous bead, from which downwardly projects a circular side wall provided with a peripheral recess, with an approximately semi-circular section and dimensioned to be fitted around the continuous tubular rib upon seating the lid on the discharge opening of the container. The peripheral edge is seated onto the closure seat when the lid is fitted on the discharge opening.

Although resulting in an excellent axial locking of the lid in the closed condition, and also eliminating the risks of manual handling injuries and of contamination of the stored product by contacting non-varnished parts of the metal sheet of the container, said prior art solution object of the Brazilian Patent PI 9408643-5 still needs to present an increased structural strength to comply with the specifications required for the containers containing dangerous products.

As known, the containers in metal sheet for storing dangerous products must withstand a determined level of inner pressure during a certain period of time, without the can being subjected to a structural deformation which impairs the tightness of the container and the seating of the press-fit lid on the closure seat. In this respect, the constructive solution object of the Brazilian Patent PI 9408643-5, optionally associated with the construction proposed for the annular upper wall object of the Brazilian Patent PI 0006493-9, also of the present applicant, allows maintaining the integrity of the container when it is submitted to the limit pressure conditions required for certifying the package as appropriate for containing dangerous products.

However, although said prior solutions guarantee an adequate retention of the lid on the closure seat in the pressure test conditions for dangerous products, they do not guarantee the integrity of the closure when the container, filled with the product, is submitted to a free fall, from a test height of usually 0.80 m to 1.5 m and against a rigid surface, with the lid turned downwards at an angle inclined at about 45°.

In the type of fall cited above, the upper marginal region of the container, to which is double seamed the annular upper wall, is submitted to a deformation or "inward denting", which can deform the closure seat at a degree sufficient to destroy the tightness of the container, even if this deformation is still insufficient to produce ejection of the lid.

Said destructive deformation of the closure seat mostly results from the higher resistance to deformation by axial forces and from the lower resistance to deformation by radial forces to which the region of the side wall of the container, which is adjacent to the impact region, is submitted during the free fall test in the inclined position.

Depending on the characteristics of the sheet used for manufacturing the container, it is also possible to have a deformation of the double-seam in the impact region, sufficient to impair the perfect tightness of the container provided with an annular upper wall (as discussed above), or with a single-piece upper wall. The problem regarding loss of tightness, caused by excessive deformation of the double-seam in the impact region, can occur both in the double-seam of the upper wall, when the container is allowed to fall in the inverted position, and in the double-seam of the lower wall, when the container is allowed to fall in the inclined but not inverted position. The deficiencies commented above can be particularly associated with the 18 liter square cans largely used in the market and in which the upper wall is provided in a single piece which is peripherally double seamed, or as an annular upper wall carrying the closure lid.

It was also verified that the containers with a cylindrical or polygonal cross-section, generally square or rectangular, presenting a storage capacity of 1 gallon and of 9 and 5 liters, respectively, and having an upper wall in a single piece and optionally provided with a respective lid, are also vulnerable to the occurrence of loss of tightness by excessive deformation of the double-seam when submitted to impact caused by the container falling in an inclined position.

In the containers with a polygonal cross-section, the double-seam regions more vulnerable to the loss of tightness are those which define the rounded vertices of the polygonal transversal contour of the upper and lower walls, which vertices define the upper and lower ends of the respective rounded longitudinal edges of the container.

When a container of polygonal cross-section of the type considered herein is dropped in the inclined position, inverted or not, so that a vertex of one of the upper or lower walls touches the impact surface, the double-seam region, which defines this vertex, may be submitted to an excessive deformation sufficient to destroy the tightness of the container in said deformed double-seam region. Although the problem regarding loss of tightness is more common in the region of the vertices when these define the impact region when the container falls, it can also occur in other rectilinear or bent double-seam parts, as in the case of the cylindrical containers.

In the containers in which the accentuated deformation of the peripheral end edges, defined by the double-seams, has no actual influence on the integrity of the lid seat and on the retention and tightness of said lid, it is very important to maintain the perfect tightness in the double-seam regions, particularly in metal sheet containers used for containing products considered hazardous.

Some of the known solutions, in order to minimize the problem related to the deformation of the closure seat and of the double-seam regions, when submitted to impact caused by the free fall of the fully loaded container and during test conditions, require the provision of auxiliary protecting devices aggregated to the container and which considerably raise the packaging cost.

Another known solution, in order to eliminate or minimize the problem regarding deformation of the closure seat and double-seam regions, upon fall of the container, is defined in documents BR 0201566-8 and DT 24 17 517 A1.

In this type of prior art solution, the tubular side wall of the container body is provided, in its upper and lower regions, adjacent to the upper and lower double seamed edges of the container, with a plurality of circumferential grooves in the form of an open V, with its opposite sides being symmetrical in relation to a median plane orthogonal to the axis of the container. Although constituting zones to be plastically deformable when the container falls in an inclined position, with the purpose of absorbing the impact energy and avoiding losing the tightness of the closure seat of the lid, if existing, and of the double-seam region submitted to deformation, this type of circumferential groove with the cross section in the form of a symmetrical V presents reduced capacity for absorbing deformation energy, requiring a higher number of grooves to absorb the deformation of the side wall and to avoid damages to the tightness of the container, but which impairs the capacity of the container to resist the stacking forces required by the current specifications.

Besides, the symmetrical V shape of the known grooves makes the tubular side wall of the container fragile to resist the compression forces, which impedes reducing the thickness of the metal sheet constitutive of the container body. Thus, the metal sheet has to be maintained with a thickness which guarantees the structural strength of the containers when submitted to compression forces upon stacking.

The rounded V-shaped grooves with a large opening angle and a reduced radial depth, as it occurs in the solution DT 24 17 517 A1, allows a high stacking structural strength to be obtained. However, this rounded V-shape with a large opening angle impairs the plastic deformation of the groove sides to absorb the impact energy.

OBJECT OF THE INVENTION

The present invention has as object to provide an improvement in the construction of a container in metal sheet, of the type which comprises a body formed by a tubular side wall having end edges to which upper and lower walls are peripherally affixed by double-seaming. The tubular body is provided with upper and lower circumferential end regions capable of deforming upon fall of the container in an inclined position at about 45°, absorbing the impact energy and preventing the loss of tightness of the double-seam and of the closure seat of the lid, if existing, without impairing the required stacking strength of said containers, even in situations in which the thickness of the metal sheet used for manufacture is reduced.

SUMMARY OF THE INVENTION

The object mentioned above is reached through the provision of a container in metal sheet, of the type which comprises a body formed by a tubular side wall having upper and lower end edges to which are affixed, by respective upper and lower double-seams, an upper wall and a lower wall, said tubular side wall presenting, close to at least one of the upper and lower double-seams, a circumferential deformation region formed by a plurality of circumferential friezes parallel and adjacent to each other and occupying a certain axial extension of the tubular side wall.

According to the invention, each frieze presents a Z-shaped profile with its end legs disposed in planes which define, with the axis of the tubular side wall, an angle between 45° and 90°, said end legs being interconnected by a median leg inclined in relation to said axis and defining, with the respective end legs at an angle not superior to 90°, the adjacent end legs of two consecutive friezes being coplanar and interconnected, by their opposite ends, to the respective median legs.

Further according to a way of carrying out the present invention, the junctions between the median leg and the end legs of each frieze are obtained by a rounded vertex portion coincident with the adjacent median and end legs. Moreover, the median legs of the friezes intersect the axial projection of the contour of the tubular side wall of the container, being also radially outwardly inclined from the adjacent double-seam and toward the median region of the container.

With the construction defined above, it is formed a circumferential deformation region on the tubular side wall, close to at least one of the upper and lower double-seams and which is dimensioned to absorb, by a localized plastic deformation, the energy resulting from the impact of the filled container, which falls generally in an inclined position, with a rigid surface. The friezes which form each circumferential deformation region make the tubular side wall region, adjacent to the impact point, more easily deformable than the adjacent region of the upper wall, preserving the double-seam regions and the inner peripheral portion of the upper wall when the container is provided with an upper opening with a lid and dropped in an inclined and inverted position, allowing to minimize the deformations in the upper wall in the form of a ring or in a single-piece and, thus, maintaining the integrity of the lid closure and of the adjacent double-seam region.

The design and dimensioning of the friezes in each circumferential deformation region further allows obtaining, as a function of the inclined median leg and of the end legs orthogonal to the axis of the container, not only a controlled and sufficient absorption of the impact energy, but also an increased structural strength for the recipients upon stacking, also allowing, in certain cases, reducing the thickness of the metal sheet to be used in the formation of said containers.

BRIEF DESCRIPTION OF THE DRAWINGS

The invention will be described below, with reference to the enclosed drawings, given by way of example of a possible embodiment of the invention and in which.

DESCRIPTION OF THE INVENTION

Figure 1:
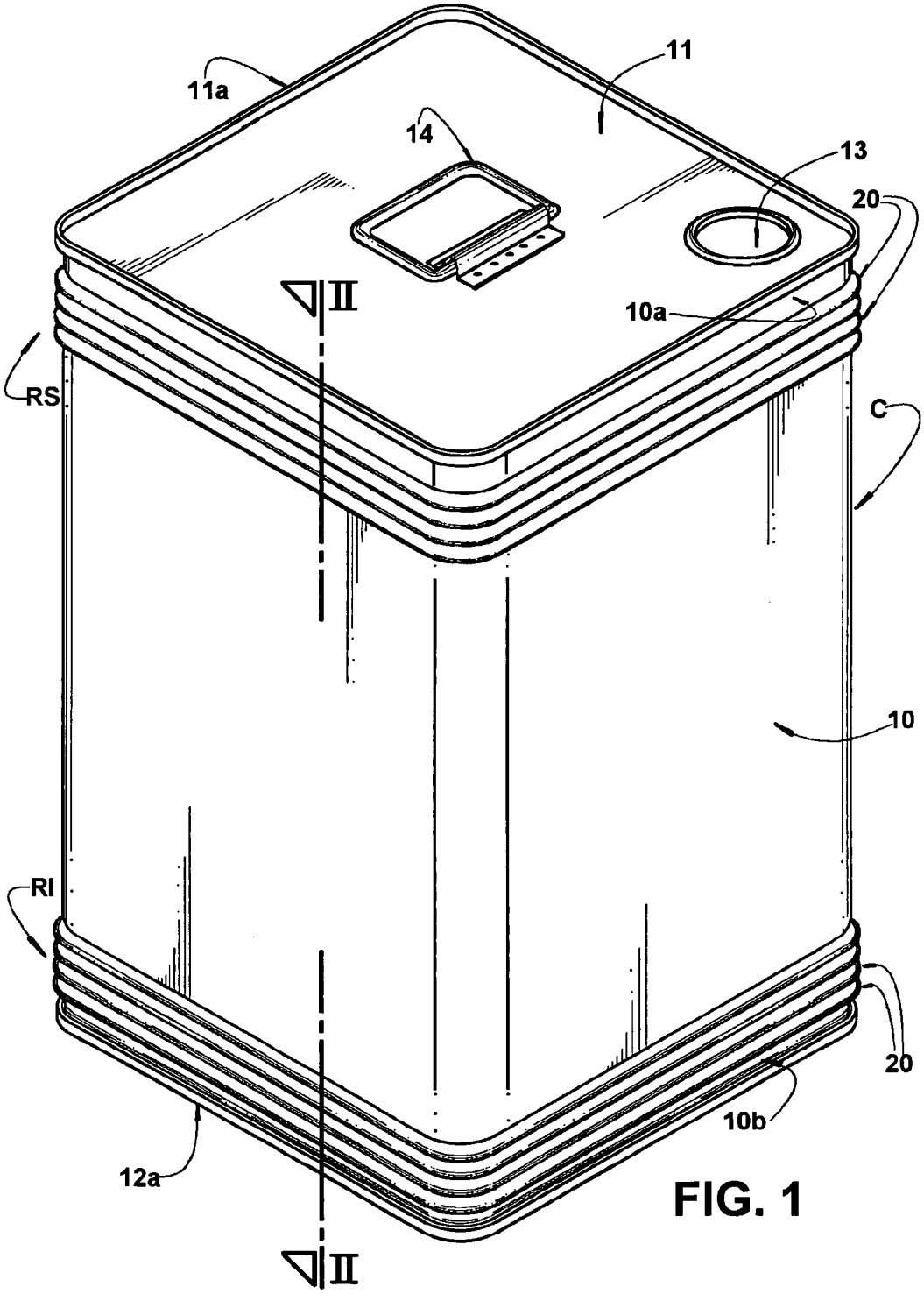
FIG. 1 represents a perspective view of a container in metal sheet, having a tubular body, with a square section and upper and lower walls, each defined in a single piece which is peripherally affixed, by double-seaming, to the upper and lower end edges, respectively, of the tubular body, the latter presenting two upper and lower circumferential deformation end regions.

In the construction illustrated in figures from 1 to 3 of the enclosed drawings, the present container comprises a body C having a tubular side wall 10 with a square contour, and an upper wall 11 in a single piece sheet, whose outer peripheral portion is conventionally affixed, by a double-seam 11*a*, to an upper end edge 10*a* of the tubular side wall 10.

Although not illustrated herein, it should be understood that the upper wall 11 can be in the form of a structural ring, peripherally double seamed to the tubular side wall 10 and whose inner opening defines a seat onto which is seated and axially retained a lid which occupies a substantial extension of the area of said upper wall 11, as illustrated in FIGS. 1 to 6 of BR 0201566-8.

The illustrated container further comprises a lower wall 12 which is peripherally and conventionally affixed, by a double-seam 12*a*, to a lower end edge 10*b* of the tubular side wall 10.

In the illustrated construction, the upper wall 11 is further provided with a small discharge opening 13 to be closed by an adequate lid, which can present different constructions, and also with a small suspension handle 14.

As illustrated, the tubular side wall 10 presents, close to at least one of the upper double-seam 11*a* and lower double-seam 12*a*, preferably close to both double-seams, an upper circumferential deformation region RS and a lower circumferential deformation region RI, respectively.

Each of said circumferential deformation regions RS, RI, is formed by a plurality of circumferential friezes 20 parallel and adjacent to each other and occupying a certain axial extension of the tubular side wall 10. According to the invention, each frieze 20 presents a Z-shaped profile with its end legs 21 disposed in planes which define, with the axis of the tubular side wall 10, an angle $\alpha$ between 45° and 90°, said end legs 21 being interconnected by a median leg 22 which is inclined in relation to said axis and defining, with the respective end legs 21, an angle $\beta$ not superior to 90°. The adjacent end legs 21 of two consecutive friezes 20 are coplanar and interconnected, by their opposite ends, to the respective median legs 22.

The use of the friezes 20 with a Z-shaped profile allows that, in an impact condition of the end edge of the container body in a fall, the friezes of the adjacent circumferential deformation region RS or RI be progressively and sequentially deformed, from the axially outermost frieze to the innermost frieze, with reduction of the angle of inclination of the median leg 22 in relation to the end legs 21 of each frieze, which deformation includes the plastic deformation of the junction of the median leg 22 with each end leg 21. This progressive and sequential plastic deformation of the friezes absorbs impact energy, preserving the tightness characteristics of the adjacent double-seam region and of the lid seat, if said lid is present in the construction of the container and if the latter has been submitted to a fall in an inverted position.

The junction of the median leg 22 with the end leg 21 of each frieze 20, is obtained by a rounded vertex portion 23, coincident with the adjacent median legs 22 and end legs 21, and which absorbs, with its deformation, a relevant amount of impact energy, without risk of breaking said junctions and consequent loss of tightness. The inclined positioning of the median legs 22 of the friezes 20, at an angle $\beta$ not superior to 90° in relation to the planes of the end legs 21, guarantees the container to present an increased structural strength in relation to the compression forces upon stacking and also prevents dynamic forces in the axial direction, which can occur during transportation of the filled containers, from provoking elastic deformations in the circumferential deformation regions RS and RI, sufficient to cause fatigue of the metal sheet in the junction regions (vertices) of the median legs 22 and end legs 21 of each frieze 20 and the consequent breaking of the tubular side wall 10.

The progressive plastic deformation of the friezes 20 caused by impact increases the hardness, by the mechanical hardening of the deformed region, particularly of the vertex regions of each frieze, allowing said regions to absorb the amount of energy resulting from the impact and which provokes said deformation.

Tests carried out with containers provided with the present improvement also showed that the container supported a stacking load much superior to that required by rules and which is defined by a stacking height of three meters, with the containers in a loaded condition. The experiments carried out with different shapes and sizes of containers in metal sheet, with volumetric capacity ranging from 1 to 20 liters, indicate that the rounded vertex portions 23, of each frieze 20, must present a bend radius "r" having a value defined between ½ and ⅔ of the radial extension of the end legs 21. In the illustrated construction, the median legs 22 of the friezes 20 intersect the axial projection PA of the contour of the tubular side wall 10 and, preferably, the median legs 22 of each frieze 20 and the coplanar end legs 21 of each two consecutive friezes 20 are symmetrical in relation to the axial projection PA of the contour of the tubular side wall 10.

This constructive arrangement allows the compression forces caused by stacking and by impact of the container upon fall in the inclined position at about 45°, to be applied according to a direction median to the Z-shape of the friezes 20, guaranteeing a progressive and sequential deformation of the friezes, by the dihedral angles closing in each of the vertices of the friezes 20, minimizing radial deformations in the alignment of the tubular side wall, particularly in the circumferential deformation region responsible for absorbing the impact energy.

Further according to the illustrated construction, the median legs 22 of the friezes 20 of the upper circumferential deformation region RS are inclined downwardly and radially outwardly from the upper double-seam 11*a*, whilst the median legs 22 of the friezes 20 of the lower circumferential deformation region RI are upwardly and radially outwardly inclined from the lower double-seam 12*a*.

The particular constructive arrangement mentioned above allows the median legs 22 of the friezes 20 to occupy a positioning that is approximately aligned with the vertical falling direction of the container, inclined at 45°, both in an inverted condition and in a normal position.

Figure 2:
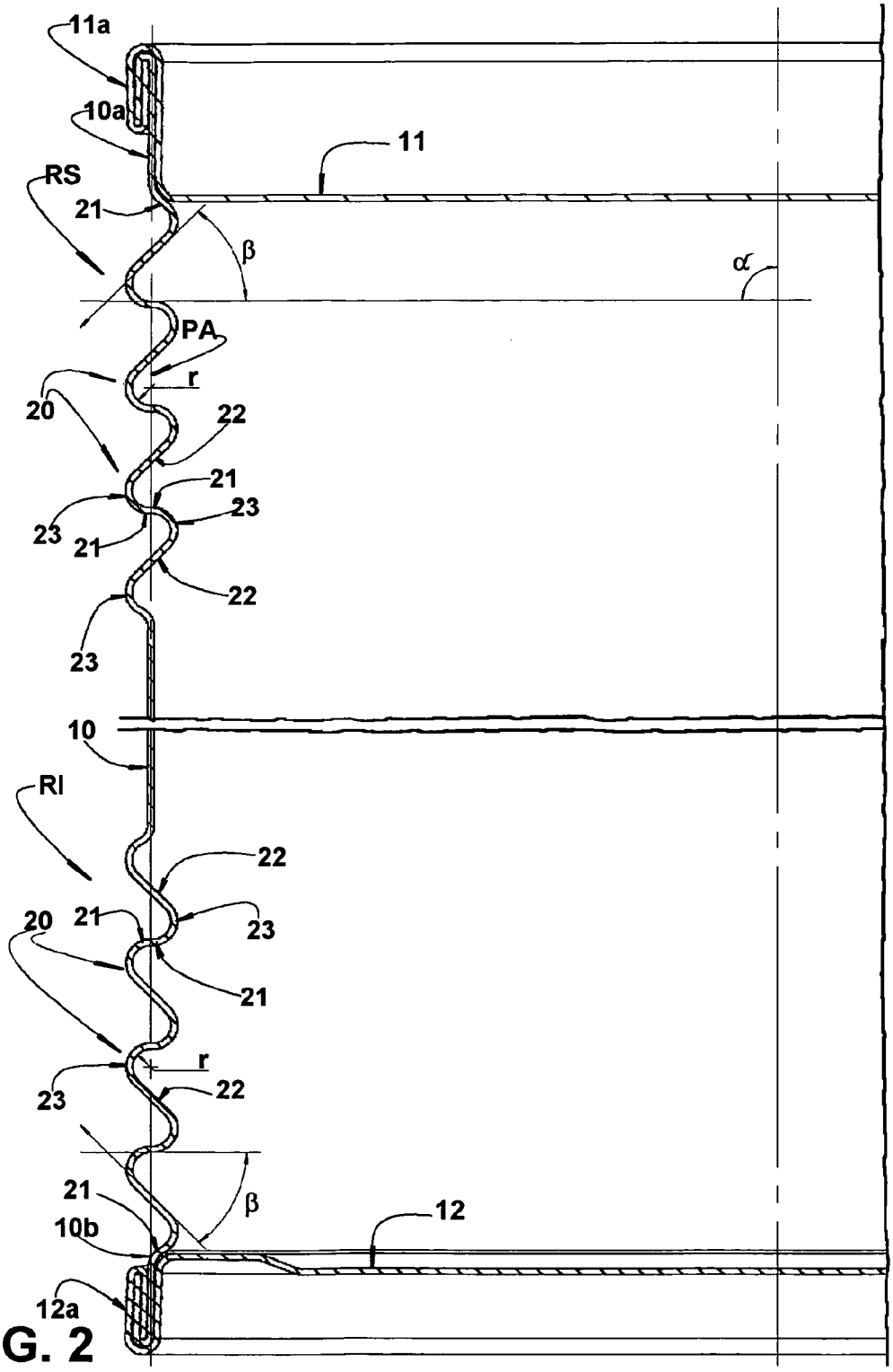
FIG. 2 represents an enlarged partial sectional view illustrating an upper portion and a lower portion of the side wall of the container body, in which the adjacent circumferential deformation regions are defined, said view taken according to line II-II in FIG. 1.
Figure 3:
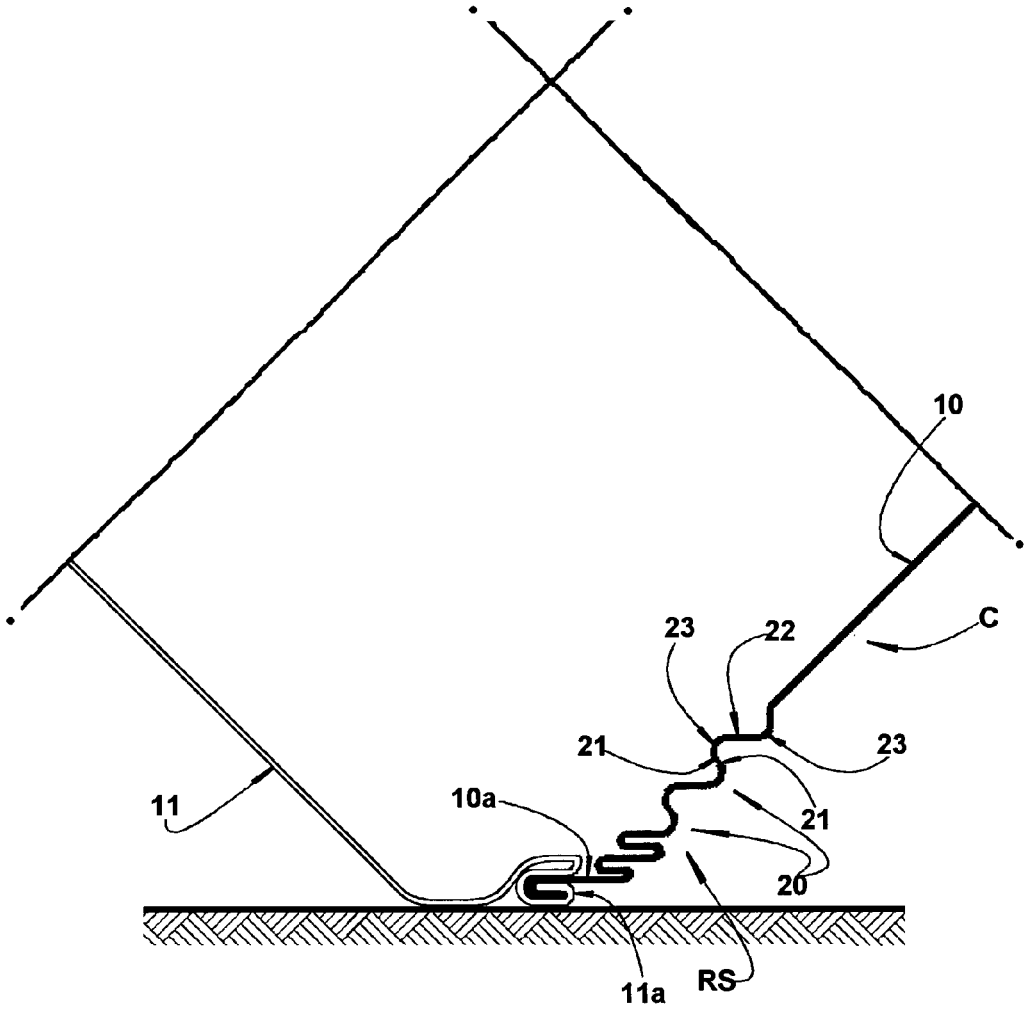
FIG. 3 represents an enlarged detailed view of the part of the container of FIG. 2 submitted to plastic deformation after the free fall of the container.

In order to obtain a better protective effect for the double-seam regions of the container, it is preferred to join each upper circumferential deformation region RS and lower circumferential deformation region RI to the adjacent upper double-seam 11*a* and inferior double-seam 12*a* by an end leg 21 of the outermost frieze 20 in the axial direction, as better illustrated in FIGS. 1 and 2.

When applying the present improvement to a container having a tubular side wall with square cross section, sheet thickness of 0.34 mm and volumetric capacity of 18 liters, each circumferential deformation region RS, RI preferably presents four friezes 20, each having a height of 7.5 mm and a total width of 9 mm.

The dimensioning of the friezes 20 of the angle of inclination of their median legs 22 and the number thereof are determined as a function of the degree of axial weakening desired for the respective upper circumferential deformation region RS and lower circumferential deformation region RI of the tubular side wall 10.

The friezes 20 can be provided with a height generally ranging from 2.5 mm to 7.5 mm and a width correspondently ranging from 3 mm to 9 mm. However, it should be understood that such measures may vary as a function of other structural characteristics of the container, including the metal sheet thickness, the existence or not of a large upper opening to be closed by a removable lid, and other constructive variants.

While the drawings illustrate only a container with a square cross section, rounded longitudinal edges and a single piece upper wall, it should be understood that the present improvement is likewise applicable to cylindrical containers with the upper wall defined by a structural ring which defines a large discharge opening into which a respective removable lid is fitted and retained.

In these constructions in which the container is provided with a large upper opening, the upper circumferential deformation region RS is designed to absorb the impact energy of the container, in an inverted position, against a rigid surface, producing deformation of the tubular side wall 10 in a region which tends to move away from the closure seat provided in the large upper opening, keeping it in conditions to tightly retain the respective lid.

It should also be noted that the friezes 20 with their end legs 21 disposed in planes which define, with the axis of the tubular side wall 10, an angle $\alpha$ between 45° and 90°, increase the structural strength of the tubular side wall 10 in the radial direction, better supporting the radial component of the impact force upon fall and, thus, better preserving the end region contour of the container which collides with the rigid surface. The impact energy is mostly absorbed by the axial plastic deformation of the friezes 20, in the circumferential deformation region RS or RI turned to the impact side, and by a corresponding denting or axial displacement of the outer peripheral portion of the annular upper wall, which is maintained double-seamed to the tubular side wall 10.

It should be understood that modifications of dimension and number of friezes can be made, without departing from the protection scope defined by the claims that accompany the present specification.

The invention claimed is:

1. An improvement in a container of metal sheet, comprising a body formed by a tubular side wall having an axis and having an upper end edge and a lower end edge to which are affixed, by an upper double-seam and a lower double-seam respectively, an upper wall and a lower wall, said tubular side wall presenting, close to at least one of the upper double-seam and lower double-seam, at least one circumferential deformation region formed by a plurality of circumferential friezes parallel and adjacent to each other and occupying a certain axial extension of the tubular side wall, the improvement being characterized in that each frieze presents a Z-shaped profile having end legs disposed in planes which define, with the axis of the tubular side wall, an angle ($\alpha$) between 45° and 90°, said end legs being interconnected by a median leg inclined in relation to said axis and defining, with respective end legs, an angle not superior to 90°, the end legs of two adjacent friezes being coplanar and interconnected, by opposite ends thereof, to respective median legs and characterized in that a junction of the median leg with the end leg, of each frieze, is obtained by a rounded vertex portion, coincident with the adjacent median leg and end leg and each rounded vertex portion presents a bend radius "r" having a value defined between ½ and ⅔ of a radial extension of the end legs of each frieze and further characterized in that the median legs of the friezes of an upper circumferential deformation region are downwardly and radially outwardly inclined from the upper double-seam, whilst the median legs of the friezes of a lower circumferential deformation region axe upwardly and radially outwardly inclined from the lower double-seam.

2. The improvement, as set forth in claim 1, characterized in that each upper circumferential deformation region and lower circumferential deformation region are connected to the adjacent upper double-seam and lower double-seam by an end leg of the outermost frieze, in the axial direction.

3. The improvement, as set forth in claim 1, in which the container has a tubular side wall with a square cross section, a metal sheet thickness of 0.34 mm and a volumetric capacity of 18 liters, the improvement being characterized in that each circumferential deformation region presents four friezes, each one having a height of 7.5 mm and a total width of 9 mm.

4. The improvement, as set forth in claim 1, characterized in that the median legs of the friezes intersect the certain axial extension of a contour of the tubular side wall.

5. The improvement, as set forth in claim 4, characterized in that the median legs of each frieze and the coplanar end legs of each consecutive two friezes are symmetrical in relation to the axial extension of the contour of the tubular side wall.

* * * * *

UNITED STATES PATENT AND TRADEMARK OFFICE

CERTIFICATE OF CORRECTION

PATENT NO. : 8,800,807 B2
APPLICATION NO. : 13/320423
DATED : August 12, 2014
INVENTOR(S) : Alvares et al.

It is certified that error appears in the above-identified patent and that said Letters Patent is hereby corrected as shown below:

In the Claims

Claim 1, col. 8, line 26, "axe" should be deleted and --are-- should be inserted.

Signed and Sealed this
Fourth Day of November, 2014

Michelle K. Lee

Michelle K. Lee
*Deputy Director of the United States Patent and Trademark Office*